United States Patent [19]

Reinehr et al.

[11] 4,400,339

[45] Aug. 23, 1983

[54] PROCESS FOR PRODUCING VERY FINE DENIER SYNTHETIC FIBERS

[75] Inventors: Ulrich Reinehr; Toni Herbertz, both of Dormagen; Hermann J. Jungverdorben, Grevenbroich; Joachim Dross, Dormagen, all of Fed. Rep. of Germany

[73] Assignee: Bayer Aktiengesellschaft, Leverkusen, Fed. Rep. of Germany

[21] Appl. No.: 213,531

[22] Filed: Dec. 4, 1980

[30] Foreign Application Priority Data

Dec. 21, 1979 [DE] Fed. Rep. of Germany ..... 2951803

[51] Int. Cl.[3] ..... D01F 6/18

[52] U.S. Cl. ..... 264/206; 264/210.1

[58] Field of Search ..... 264/206, 207, 208, 210.1

[56] References Cited

U.S. PATENT DOCUMENTS

| | | | |
|---|---|---|---|
| 1,941,204 | 12/1933 | Dreyfus | 264/208 |
| 1,950,026 | 3/1934 | Dreyfus et al. | 264/208 |
| 2,072,100 | 3/1937 | Dreyfus et al. | 264/208 |
| 3,097,415 | 7/1963 | Davis | 264/206 |
| 4,140,844 | 2/1979 | Lowasser | 264/206 |
| 4,163,770 | 8/1979 | Porosoff | 264/206 |
| 4,205,039 | 5/1980 | Streetman et al. | 264/206 |
| 4,219,523 | 8/1980 | Porosoff | 264/206 |

FOREIGN PATENT DOCUMENTS

| | | | |
|---|---|---|---|
| 47-11254 | 4/1972 | Japan | 264/182 |
| 53-94625 | 8/1978 | Japan | 264/182 |
| 53-147818 | 12/1978 | Japan | 264/206 |

OTHER PUBLICATIONS

Chemiefasern/Textilindustrie, (1979), part 1, pp. 30–34, part 3, pp. 175–178.

*Primary Examiner*—Jay H. Woo

*Attorney, Agent, or Firm*—Sprung, Horn, Kramer & Woods

[57] ABSTRACT

Dry-spun synthetic fibers and filaments having an individual as-spun denier of 3 dtex are obtained by dry-spinning a viscosity-stable spinning solution with a draft of at least 20.

6 Claims, 1 Drawing Figure

PROCESS FOR PRODUCING VERY FINE DENIER SYNTHETIC FIBERS

Figure 1:
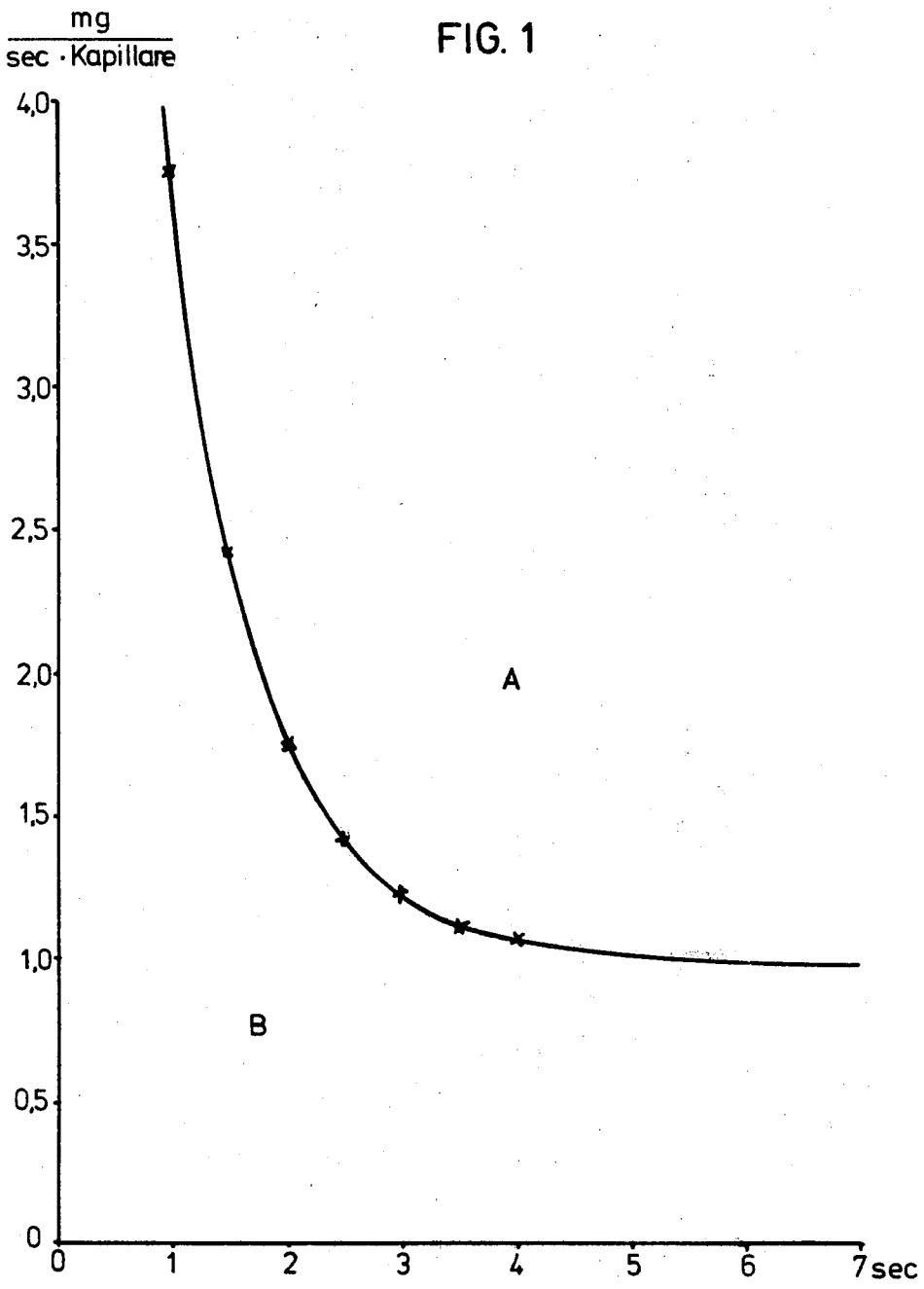

Recently, efforts have been made to an increasing extent in the synthetic fibre industry to produce synthetic fibres which have particularly fine deniers. Fine-denier fibres of this type, which usually have a final fibre denier of between 0.4 and 0.8 dtex, have a number of advantages compared with traditional synthetic fibres, e.g., acrylic fibres which are in the denier range starting from 1.3 dtex; these advantages include a bright gloss, a considerable lustre, an elegance in sheet structures, a soft feel, a high flexibility and pliancy and also a considerable fibre strength, dependent on the large number of fine fibres in the yarn cross section.

In Chemiefasern/Textilindustrie (1979), part 1, pages 30–34 and part 3, pages 175–178, M. Okamato has summarised all the processes which are presently known in the literature. As can be inferred from this survey, very fine denier synthetic fibres are mainly produced by changes pertaining to the apparatus in the spinning process, e.g. by means of flash and airjet spinning by shearing force, coagulation force, impact force or centrifugal force methods. In the conventional spinning methods, only spinning polymeric mixtures which are incompatible with each other into polymer blend fibres having a matrix/fibril structure has become significant. By removing the polymer matrix, very fine denier fibrillar fibres are obtained which are mainly used as synthetic upper leather.

The present invention is based on the object of producing very fine denier synthetic fibres, predominantly acrylic fibres, by means of a dry spinning process.

In order to be able to obtain very fine denier fibres according to such a process, the spinning solution must be exposed to a high draft in the spinning shaft. The draft (V) in spinning is defined as the ratio of the draw-off rate to the extrusion rate:

$$V = \frac{v \text{ draw-off (m/min.}^{-1})}{v \text{ extrusion rate (m/min.}^{-1})}.$$

The extrusion rate (S) is obtained as:

$$S = \frac{4 \cdot F \text{ (min/min.}^{-1})}{Z \cdot d^2 \cdot 11 \cdot 100}$$

F = Conveyed quantity in ccm/min.
Z = Number of nozzle holes.
$d^2$ = Diameter of nozzle holes in cm.

In the conventional process for dry spinning of, for example, acrylic filaments, a draft of approximately 10 to 20 times is exerted on the spinning solution. If it is attempted to draft spinning solutions of this type to a greater extent under the spinning conditions which are usually used, then tears in the filaments appear until finally the face of the spinning material collpases in the region of the nozzle. Therefore, it is impossible to obtain very fine denier filaments and fibres by simply increasing the draft in a dry spinning process.

Surprisingly, it has now been found that it is nevertheless possible to exert high drafts which are required to produce, fine and very fine deniers even in a dry spinning process, provided, on one hand, viscosity-stable spinning solutions are spun and, on the other hand, mild thermal conditions are selected in the spinning shaft which stipulate a slower evaporation of the spinning solvent than is usual in a conventional dry spinning process.

Thus, the present invention provides a process for producing synthetic fibres and filaments with individual spinning deniers of 3 dtex and less from filament-forming synthetic polymers according to a dry spinning process, which is characterised in that viscosity-stable spinning solutions are spun under thermal conditions such that a draft of at least 20, preferably from 30 to 500, is made possible and the spun material which is thus obtained is further treated in a conventional manner to produce finished filaments or fibres.

According to this process, filaments and fibres of the mentioned fineness of denier may be produced which do not have the dumbbell-shaped cross sections which are usual in dry spinning. The invention also relates to such filaments.

The process of the invention is in principle a dry spinning process which may be carried out using the same apparatus as a process by which coarser deniers are spun. Therefore, the process may be carried out for example using conventional spinnerets having hole diameters of from about 0.15 to 0.8 mm, preferably from 0.2 to 0.4 mm, and in conventional spinning shafts. The spinning solutions which are used are also the solutions which are conventional in this technology and have solids contents of from about 25 to 35%. At average K-values of the polymers of approximately 80, the spinning solutions thereby have viscosities of from about 20 to 100 falling ball seconds at 80° C. (regarding the falling ball method, see K. Jost, Rheologica Acta (1958) Vol. 1, No. 2–3, page 303).

In order that, according to the process of the invention, the high draft which is preferably from 30 to 500 but may even by higher, may be exerted, attention must be paid, dependent on the product which is required, on maintaining certain marginal conditions. Thus, for example, viscosity-stable spinning solutions must be used, i.e. spinning solutions the viscosity of which (measured in falling ball seconds) changes during the spinning time, i.e. for hours for at most 5%, preferably less than 1%, and best not at all. Such solutions have proved to be particularly highly draftable, while spinning solutions which do not have a constant viscosity tend to suffer filament tears at high drafts to an increasing extent (compare Example 2). A viscosity-stable spinning solution may be prepared by maintaining the solution at a certain minimum temperature for a certain time before being spun.

It is obvious that the preparation of such a viscosity-stable solution depends on the nature of the polymer which is used and on the nature of the chosen solvent. According to the invention, acrylonitrile polymers are preferably spun, particularly those which consist of at least 40% by weight, preferably of at least 85% by weight, of acrylonitrile units. The known polar organic solvents are included as spinning solvents, particularly dimethyl acetamide, dimethyl sulphoxide, ethylene carbonate, N-methyl pyrrolidone, but preferably dimethyl formamide. In the case of polymers consisting of 100% of acrylonitrile and with conventional K-values of e.g. 80, the thermal preliminary treatment which is mentioned above, when using dimethyl formamide (DMF) as the solvent, is at least approximately 4 minutes at at least approximately 140° C. Acrylonitrile polymers having a content of comonomers, which are usual in this technology, may be pre-treated at slightly lower temperatures of approximately from 125° to 130° C. for the mentioned period of time, in order to obtain the required viscosity stability of the solution. According to the choice of the polymer and the solvent, a few preliminary experiments to determine the optimum conditions of the thermal preliminary treatment in order to obtain the viscosity stability are advised, if not required.

The above mentioned dependency of the products of the process on the marginal conditions which are explained in the following is understood as follows: very surprisingly, it has been found that according to the process of the invention, not only the dumbbell-shaped fibre cross-section may be obtained which is usually obtained in the dry spinning process, but also circular, round and bean to kidney shapes, according to the manner in which the thermal conditions are selected in the spinning shaft.

As far as the thermal conditions in the spinning shaft are concerned, it is very difficult to make any absolute statements on this subject, as the skilled man knows very well, since these thermal conditions are dependent, for example, on the physical data of the selected spinning solvent.

If, for example, dimethyl formamide is used as the solvent, then it can be very generally said about the thermal conditions in the spinning shaft that the spinning solution should not be at a temperature of more than 150° C., the temperature in the spinning shaft should not exceed 200° C. and the spinning atmospheric temperature should be approximately 400° C. at the highest.

Where there are low spinning solution temperatures, extremely high drafts are attained and thus very fine deniers may be spun. On this subject, it may again be said very generally that the lower the spinning solution temperature is, the higher the draft that may be selected. However, low spinning solution temperatures presuppose viscosity-stable spinning solutions as it is only in this manner that a cold gelling of the spinning solution may be prevented. Therefore, for example, from a viscosity-stable arcylic spinning solution of 35° C. with a draft of 457, an individual spinning denier of 0.2 dtex could be obtained which, after a 3.6-fold stretching, led to filaments with final titres of 0.07 dtex (Example 1).

What was established for the temperature of the spinning solution applies to the same extent to the temperature of the shaft and the air in dry spinning according to the invention of fine or very fine denier fibres. Low temperatures alow spinning at high drafts as a result of a slow evaporation of the solvent (e.g. DMF) in the spinning shaft and thus allow the production of extremely fine deniers. However, with an increasing spinning denier starting from approximately 1 dtex, due to the increased polymer throughput, the spinning temperature should be raised in order to avoid adhesion and filament tears.

Specifically, according to the process of the invention, a cross-sectional form of the fine denier fibres which is not dumbbell-shaped is always obtained when the spinning conditions are chosen to be as mild as possible and when the process is carried out at high drafts. In this case, for example, the spinning solution is cooled to temperatures of from about 20° C. to about 100° C. after the viscosity-stabilising thermal treatment and before spinning, the spinning shaft temperature is simultaneously adjusted to a figure between approximately 30° C. and preferably below the boiling point of the solvent which is used and the process is carried out using spinning air up to a temperature of approximately 300° C. In other words, care is taken that the solvent from the solution flow issuing from the nozzle is not evaporated abruptly or even relatively rapidly, but very gradually and as evenly as possible over the total length of the shaft. As a result of this, the circular to round cross-sectional forms are produced which are very unusual for dry-spun filaments and fibres. However, if the thermal spinning conditions are raised into the upper regions which were mentioned before, i.e. if, for example, an acrylonitrile polymer/DMF-spinning solution is spun which is at a temperature of approximately from 90° to 150° C., at shaft temperatures of e.g. from 150° to 200° C. and atmospheric temperatures of 300° C. and above, then the solvent evaporates faster, as a consequence of which the draft cannot be selected to be as high as in the previous case so that the cross sections of the fibres exhibit the known dumbbell shape. If the spinning conditions are set at figures which are substantially in between the figures which were previously indicated, then the cross section of the fibres also exhibits an intermediate form, e.g. a bean-shaped or kidney-shaped form.

For all this, care must naturally be taken that the filaments are adequately secured at the shaft outlet.

These explanations show that it is possible, according to the process of the invention, to vary the fineness and cross sectional form of the filaments which are obtained. Such a determination of the fibre cross section may be required for one or other purposes of use.

The DMF-evaporation rates per capillary (in mg/sec.) in connection with the time the filaments remain in the spinning shaft have proved to be useful as suitable measurements to describe the resulting cross-sectional form. As has been found in numerous spinning experiments, the DMF-evaporation rate at one second residence time in the spinning shaft must not exceed the figure of $$3.75\left(\frac{\text{mg}}{\text{sec. capillary}}\right)$$

if cross-sectional forms which are not yet dumbbell-shaped are to be obtained. With longer times in the spinning shaft, for example two seconds, the evaporation rate has to be slower, and at shorter residence times the evaporation rate must be correspondingly faster.

FIG. 1 shows the curve which is obtained when the DMF-evaporation rate in $$\left(\frac{\text{mg}}{\text{sec. capillary}}\right)$$

is recorded as the ordinate against the residence time (in seconds) in the spinning shaft as the abscissa. The curve approximates a hyperbola which divides the area into dumbbell- and non-dumbbell-shaped fibre cross section structures. The term "non-dumbbell-shaped fibre cross section profiles" is understood in this case to designate both bean-shaped as well as kidney-shaped and round cross-sectional forms and also transitions between the individual profiles. As can be seen from FIG. 1, the values of the ordinate in the form of the DMF-evaporation rate are a measurement for the thermal spinning conditions such as shaft, atmospheric and spinning solution temperature, while the values of the abscissa in the form of the residence time of the filaments in the spinning shaft represent a measurement for the mechanical spinning conditions, such as draw-off rate and length of shaft. Each point on the curve in FIG. 1 constitutes a determined DMF-quantity, whereby the DMF-content in the thread may vary according to the denier. In other words, this means that the path of the curve does not depend on the spinning denier. It can also be gathered from the path of the curve that in each case a determined quantity of DMF must be evaporated in order to change the cross-sectional structure. With short residence times, this quantity is considerably greater than with longer residence times in the spinning shaft. On the other hand, below a certain evaporation rate, independent of the residence time, dumbbell-shaped cross sections are never obtained.

The DMF-evaporation rate per capillary in (mg/sec.) may be determined from the difference between the quantity of spinning solvent which is carried through per capillary (mg/sec.) and the residual quantity of solvent per capillary (mg/sec.). This is indicated in an illustrative calculation for Example 1. The following applies:

Throughput of polymer solids in (gm/sec.):

$$\frac{\text{Total spinning denier } (dtex) \times \text{draw-off rate (m/min)}}{10{,}000} = \frac{144 \times 400}{10{,}000} = 5.76;$$

Throughput of spinning solvent (g/min):

$$\frac{\text{Polymer solids (g/min)} \times \text{concentration of spinning solution}}{\text{Concentration of solids}} = \frac{5.76 \times 70.5}{29.5} = 13.765;$$

Residual quantity of solvent in the spinning material (g/min):
After the spinning process, 9.9% of residual solvent DMF based on solids were established.
The following applies:
5.76 g = 100%
x = 9.9%
x = 0.570 g of DMF remain in the spinning material.
DMF-evaporation rate (g/min) = 13.765 − 0.570 = 13.195;
DMF-evaporation rate per capillary (mg/sec) =

$$\frac{\text{DMF-evaporation rate (g/min)} \times 1000}{\text{number of holes} \times a} = \frac{13.195 \times 1000}{720 \times 60} = 0.305$$

The process according to the invention was usually carried out using DMF-spinning solutions having a polymer content of 29.5% by weight. At higher concentrations, as is seen from Example 6, a lower evaporation rate $R_1$ is required so that cross sections are obtained which are not dumbbell shaped. The values follow the empirical formula:

$$\frac{C_{1\,DMF}}{C_{2\,DMF}} \times R_2 = R_1$$

whereby, $C_1$ DMF represents the concentration of spinning solvent which was used;

$C_2$ DMF represents 70.5% by weight of DMF; and $R_2$ represents the DMF-evaporation rate $$\left(\frac{\text{mg}}{\text{sec. capillary}}\right)$$

for the spinning solution concentration $C_2$. The value of $R_2$ may be taken directly from the curve of FIG. 1 for the corresponding residence time in the spinning shaft (in seconds). Thereby, the residence time (in seconds) of the filaments in the spinning shaft is calculated from the relation:

$$\text{Residence time} = \frac{\text{length of shaft (m)} \times 60}{\text{Draw-off rate (m/min)}}$$

Accordingly, for Example 6, the DMF-evaporation rate $R_1$ is calculated as follows for the spinning solution concentration other than 70.5% by weight of DMF in which there is a change in the cross-sectional form:

$$R_1 = \frac{C_{1\,DMF}}{C_{2\,DMF}} \times R_2;\ R_1 = \frac{65}{70.5} \times 3.05 = 2.81\left(\frac{\text{mg}}{\text{sec. cap.}}\right)$$

$$R_2 = 3.05\left[\frac{\text{mg}}{\text{sec. cap.}}\right] \text{ at 1.16 sec. residence time in the spinning shaft.}$$

Apart from the changed fibre cross sectional form of fine-denier fibres which have been produced according to the process of the invention, fibres of this type which do not have a dumbbell-shaped cross-sectional profile still have an extremely high gloss. This leads to a high elegance in the sheet structure of articles for use. As is shown by surface morphological experiments using a scanning electron microscope, the fine-denier fibres according to the invention do not have abarky-fibrillated surface with a furrow-restricted length at an alternating angle to the fibre axis, in contrast to conventionally spun acrylic fibres. The fine-denier fibres have smooth surfaces and furrows and striae extending parallel to the fibre axis, which are not interrupted, so that the light is reflected in a direct manner. As a result of the greater fineness of the yarn (Nm 100/1), fine-denier fibres, e.g. in interlock fabrics, of 3-cylinder yarns have a very soft feel in contrast to traditional acrylic materials of 1.6 dtex fibres. This is particularly useful for articles which are worn close to the skin.

It has proved to be extremely favourable, when after-treating fine-denier spun material, to warm up the spun material to about 79° to 80° C. before the stretching process which comprises passing the spun material through tubs containing warm washing liquid, preferably water, in order to achieve a more even stretching. The fine-denier upon material may be subsequently treated to produce finished acrylic fibres in a conventional manner by washing-stretching-preparing-drying-crimping-cutting steps. Due to the great fineness of denier of the filaments, particularly with spinning deniers of less than 1 dtex, it is also advantageous to carry out the stretching step in stages.

The process according to the invention is not restricted to the production of the finest deniers from acrylic fibres. Linear, aromatic polyamides, which optionally still have heterocylic ring systems, such as benzimidazoles, oxazoles, thiazoles etc, and which may be produced according to a dry spinning process, for example polyamide from m-phenylenediamine and isophthalic acid, may also be spun into the finest deniers according to the process of the invention.

By the process according to the invention, it is firstly possible to produce fibres having extremely fine final deniers of e.g. 0.1 dtex also in a greater tonne-scale. The denier determination according to the gravimetric acid is very unprecise with fine deniers (<0.5 dtex). Therefore, the denier was determined according to the microscopic method by asvertaining the thread diameter "d" using an eyepiece micrometer according to DIN 53 811 by the formula:

$$\text{Denier } (dtex) = \frac{d^2\ (\mu m) \cdot \text{thickness } (g/cm^3)}{127}$$

Literature: Chemiefasern (1975), Part 7, Page 593.

The following Examples are used to explain the invention in more detail. Parts and percentages relate to weight, unless indicated otherwise.

EXAMPLE 1

70.5 kg of dimethylformamide (DMF) were mixed with 29.5 kg of an acrylonitrile copolymer of 93.6% acrylonitrile, 5.7% of methyl acrylate and 0.7% of sodium methallyl sulphonate having a K-value of 81, with stirring and were heated with steam at 3.2 bars pressure in a 60 cm long, double-walled pipe having an internal diameter of 8 cm. The temperature of the solution, which had a solids concentration of 29.5% by weight, was 135° C. at the tube outlet. Several mixing combs were located in the tube to homogenise the spinning solution. After leaving the heating device, the spinning solution was filtered and introduced into the spinning shaft. The residence time from the heating device to the spinneret was 8 minutes. The spinning solution had a viscosity of 30 falling ball seconds, measured at 80° C. This figure was unchanged after measurements at 1.3 and 5 hours. The spinning solution was then cooled to 35° C. and was dry spun from a 720-hole spinneret having nozzle hole diameters of 0.2 mm. The temperature in the shaft was 50° C., the air temperature was 200° C. and the quantity of air was 40 $m^3/h$. The draw-off rate was 400 m/min. The residence time of the filaments in the spinning shaft was 0.87 seconds. 19.8 ccm/min were conveyed out of the spinning pump. The total as-spun denier was 144 dtex and the residual solvent content of DMF in the spun material was 9.9% by weight, based on polymer solids. The DMF-evaporation rate is in this case calculated to be 0.305.

$$\left[\frac{\text{mg}}{\text{sec. Capillary}}\right]$$

The individual as-spun denier was 0.2 dtex. The draft V was 457.

The filaments were wetted at the shaft outlet with an oleiferous preparation, wound onto bobbins, doubled into a tow, stretched in boiling water in a ratio of 1:3.6 and subsequently treated in a conventional manner to form fibres with an individual final denier of 0.07 dtex.

To judge the cross-sectional geometry microscopically, the fibre capillaries were embedded in methyl methacrylate and were cut cross-wise. The light mocroscopic recordings which were produced in the differential interference contrast method showed that the sample cross sections are completely regular and round. The denier number was calculated from the filament diameter d=2.8μm with the given thickness =1.17 $g/cm^3$. The average filament diameter was determined using the fibre measuring eyepiece. The fibres has an extremely high gloss. From examinations usng the scanning electron microscope, the fibres exhibited smooth surface with longitudinally-striated furrows. The striae were in a completely parallel path to the fibre axis and were not interrupted, in contrast to those of traditional acrylic fibres.

EXAMPLE 2 (Comparison)

A part of the mixture from Example 1 was dissolved in the heating device at 80° C. instead of at 135° C. and the viscosity of the spinning solution was determined at 80° C. after filtration. The spinning solution had a viscosity of 76 falling ball seconds. In reproducibilty measurements, the viscosity was 72 after 1 hour, 67 after 3 hours, and 64 falling ball seconds after 5 hours. Therefore, the spinning solution had a decreasing viscosity. After filtration, the spinning solution was re-cooled at 35° C. and was dry spun into filaments from a 720-hole nozzle as described in Example 1. Tears in the filaments appeared repeatedly in the nozzle region. As was shown by light microscopic cross-sectional recordings, there were also numerous fluctuations in the denier.

EXAMPLE 3

An acrylonitrile copolymer, having the chemical composition of Example 1, was dissolved in DMF, as described in Example 1, filtered and the spinning solution was cooled to 40° C. upstream of the nozzle. The solution was then dry spun from a 720-hole spinneret having nozzle hole diameters of 0.2 mm. The temperature in the shaft was 50° C., the air temperature was 200° C. and the quantity of air was 40 $m^3/h$. The draw-off rate was 250 m/min and the time the filaments remained in the spinning shaft was 1.39 seconds. 52.8 ccm/min were conveyed out of the spinning pump. The total as-spun denier was 648 dtex. The residual solvent content in the spun material was 10.8%. The DMF-evaporation rate was 0.856

$$\left[\frac{\text{mg}}{\text{sec. capillary}}\right].$$

The individual as-spun denier was 0.9 dtex. The draft was 107.

The threads were again wetted at the shaft outlet with an oleiferous preparation, wound onto bobbins, doubled into a tow, stretched in boiling water in a ratio of 1:3.6 and subsequently treated in a conventional manner to form fibres having a final denier of 0.3 dtex. The fibres cross sections were again completely even and circular. The fibres again had a very high gloss and, in the scanning electron microscope, exhibited a smooth surface having longitudinally-striated furrows parallel to the fibre axis.

EXAMPLE 4

An acrylonitrile copolymer, having the chemical composition of Example 1, was dissolved in DMF as described there. The spinning solution was then filtered, cooled at 90° C. and dry spun from a 720-hole spinneret having a nozzle hole diameter of 0.2 mm. The temperature in the shaft was 150° C., the air temperature was 200° C. and the quantity of air was 40 $m^3/h$. The draw-off rate was 180 m/min. The fibers were spun in a shorter dimensioned spinning shaft so that there was a residence time of 1.66 seconds. 82.8 ccm/min were conveyed out of the spinning pump. The total as-spun denier was 1304 dtex. The residual solvent content in the spun material was 13.5%. The DMF-evaporation rate was 1.225

$$\left[\frac{\text{mg}}{\text{sec capillary}}\right].$$

The individual as-spun denier was 1.8 dtex. The draft was 48. The filaments were subsequently treated to form fibres having a final denier of 0.6 dtex with a stretching ratio of 1:4.0. The fibres had a round to slightly bean-shaped cross sectional profile. Their gloss was again extremely high. In the scanning electron microscope, furrows and striae extending parallel to the fibre axis and without any interruptions could again be observed on the surface.

In the following Table, the dependence of the cross sectional form on the DMF-evaporation rate in $$\left[\frac{\text{mg}}{\text{sec capillary}}\right]$$

is demonstrated by spinning experiments. With an increasing spinning denier, the energy ratios in the spinning shaft must be increased, since with an increasing solution throughout, more spinning solvent must evaporate in order to obtain a strengthening in the filaments. The spun materials was respectively stretched in boiling water in a ratio of 1:3.6 and subsequently treated as usual. The individual as-spun and individual final deniers were again determined according to the light microscopic method and the cross-sectional forms were determined using light microscopic recordings according to the differential interference contrast method. The varying residence times in the spinning shaft, in addition to varying draw-off rates, were also obtained from other shaft lengths. As can be seen from the Table, cross-sectional forms which deviate from the dumbbell shape appear predominantly with as-spun deniers which are finer than 3 dtex. However, as is shown by Examples 12 and 17, with as-spun deniers of from 3.0 dtex and finer as well, dumbbell-shaped fibre cross sections are also produced provided the DMF-evaporation rate in $$\left[\frac{\text{mg}}{\text{sec. capillary}}\right]$$

is selected high enough. Therefore, with this measured quantity, as has already been mentioned, a suitable parameter is available to determine the cross-sectional form.

TABLE

| No. | No. of nozzle holes/ϕ | Draw-off rate m/min | Conveyed quantity $cm^3/min$ | Temperature °C. spinning solution | Shaft | Air | Quantity of air $m^3h$ | draft (V) |
|---|---|---|---|---|---|---|---|---|
| 1 | 720/0.2 | 400 | 39.16 | 35 | 50 | 200 | 40 | 228 |
| 2 | 720/0.2 | 400 | 138.6 | 57 | 90 | 200 | 40 | 65 |
| 3 | 360/0.3 | 400 | 129.0 | 96 | 90 | 200 | 40 | 79 |
| 4 | 360/0.3 | 400 | 148.8 | 96 | 90 | 200 | 40 | 68 |
| 5 | 36/1.5 | 400 | 49.6 | 35 | 50 | 350 | 40 | 512 |
| 6 | 360/0.15 | 300 | 14.1 | 35 | 50 | 120 | 40 | 135 |
| 7 | 360/0.175 | 300 | 27.9 | 35 | 50 | 120 | 40 | 93 |
| 8 | 360/0.175 | 300 | 76.5 | 35 | 50 | 200 | 40 | 34 |
| 9 | 360/0.175 | 300 | 139.2 | 35 | 50 | 300 | 40 | 19 |
| 10 | 826/0.2 | 400 | 80.0 | 60 | 70 | 200 | 40 | 114 |
| 11 | 826/0.2 | 400 | 180.0 | 70 | 60 | 200 | 40 | 57 |
| 12 | 330/0.3 | 400 | 90.6 | 50 | 70 | 200 | 40 | 103 |
| 13 | 330/0.3 | 400 | 135.0 | 60 | 70 | 200 | 40 | 68 |
| 14 | 720/0.2 | 200 | 48.6 | 50 | 140 | 210 | 40 | 100 |
| 15 | 720/0.2 | 200 | 97.7 | 35 | 140 | 210 | 40 | 50 |
| 16 | 360/0.175 | 200 | 69.6 | 35 | 50 | 210 | 40 | 37 |
| 17 | 720/0.2 | 200 | 146.3 | 75 | 140 | 210 | 40 | 32 |
| 18 | 360/0.3 | 200 | 93.0 | 75 | 140 | 230 | 40 | 55 |
| 19 | 826/0.2 | 180 | 87.0 | 70 | 160 | 200 | 40 | 54 |
| 20 | 328/0.3 | 180 | 92.4 | 70 | 160 | 300 | 40 | 45 |
| 21 | 360/0.3 | 100 | 12.4 | 35 | 50 | 200 | 40 | 205 |
| 22 | 360/0.3 | 100 | 49.2 | 35 | 50 | 200 | 40 | 52 |
| 23 | 720/0.2 | 50 | 24.6 | 35 | 50 | 200 | 40 | 46 |

| No. | Residence time (Sec.) | DMF spun material % | DMF evaporation rate $\left[\frac{\text{mg}}{\text{sec. cap.}}\right]$ | Individual as-spun denier dtex | Individual-final denier dtex | Cross-sectional form |
|---|---|---|---|---|---|---|
| 1 | 0.87 | 14.6 | 0.702 | 0.47 | 0.16 | Circular |
| 2 | 0.87 | 32.0 | 2.072 | 1.5 | 0.52 | slightly bean-shaped |
| 3 | 0.87 | 46.3 | 3.468 | 2.7 | 0.94 | bean to kidney-shaped |
| 4 | 0.87 | 32.2 | 4.274 | 3.1 | 1.1 | dumbbell-shaped |
| 5 | 0.87 | 41.5 | 16.852 | 12.8 | 4.4 | dumbbell-shaped |
| 6 | 1.16 | 13.0 | 0.452 | 0.40 | 0.13 | round |
| 7 | 1.16 | 17.0 | 1.066 | 0.80 | 0.28 | round |
| 8 | 1.16 | 34.5 | 2.249 | 2.2 | 0.76 | bean-shaped |

TABLE -continued

| | | | | | | |
|---|---|---|---|---|---|---|
| 9 | 1.16 | 50.5 | 3.770 | 4.0 | 1.39 | dumbbell-shaped |
| 10 | 1.32 | 15.4 | 1.178 | 0.79 | 0.27 | round |
| 11 | 1.32 | 40.1 | 2.214 | 1.67 | 0.58 | round to bean shaped |
| 12 | 1.32 | 22.6 | 3.058 | 2.12 | 0.74 | dumbbell-shaped |
| 13 | 1.32 | 28.2 | 4.426 | 3.15 | 1.09 | dumbbell-shaped |
| 14 | 1.74 | 10.0 | 0.763 | 1.0 | 0.35 | round to bean shaped |
| 15 | 1.74 | 17.8 | 1.475 | 2.0 | 0.69 | bean-shaped |
| 16 | 1.74 | 29.4 | 2.096 | 3.0 | 1.04 | bean to dumbbell shaped |
| 17 | 1.74 | 19.0 | 2.200 | 3.0 | 1.04 | dumbbell-shaped |
| 18 | 1.74 | 31.4 | 2.768 | 4.0 | 1.39 | dumbbell-shaped |
| 19 | 1.93 | 12.5 | 1.223 | 1.80 | 0.63 | bean-shaped |
| 20 | 1.93 | 15.0 | 3.024 | 4.50 | 1.56 | dumbbell-shaped |
| 21 | 3.48 | 10.3 | 0.381 | 1.0 | 0.35 | round |
| 22 | 3.48 | 24.2 | 1.621 | 4.52 | 1.57 | dumbbell-shaped |
| 23 | 6.96 | 16.8 | 0.393 | 2.12 | 0.73 | bean-shaped |

EXAMPLE 5

(a) An acrylonitrile copolymer, having the chemical composition of Example 1, was dissolved in DMF as is described there, filtered and the spinning solution was maintained at 112° C. upstream of the nozzle. The fibres were then dry spun from a 1050-hole spinneret having a nozzle hole diameter of 0.25 mm. The temperature in the shaft was 150° C., the air temperature was 260° C. and the quantity of air was 40 $m^3/h$. The draw-off rate was 300 m/min and the residence time of the filaments in the spinning shaft was 1.76 seconds. 193.2 ccm/min were conveyed out of the spinning pump. The total as-spun denier was 1903 dtex. The residual solvent content in the spun material was 8.3%. The DMF-evaporation rate was 2.090

$$\left[\frac{\text{mg}}{\text{sec. capillary}}\right].$$

The individual as-spun denier was 1.81 dtex. The draft was 80. The filaments were again wetted with an oleiferous preparation at the shaft outlet, were collected on bobbins, double into a tow, stretched in boiling water in a ratio of 1:4.0 and subsequently treated in a conventional manner to form fibres. The final fibre denier was 0.56 dtex. The fibres have the typical dumbbell-shape.

(b) A part of the mixture from Example 5a were cooled to 40° C. upstream of the nozzle after the dissolving and filtration step and was dry spun from a 1050-hole spinneret having a nozzle hole diameter of 0.25 mm. The shaft temperature was 190° C., the air temperature was 380° C. and the quantity of air was 40 $m^3/h$. The draw-off rate was 250 m/min and the residence time of the filaments in the spinning shaft was 2.11 seconds. 161 ccm/min were conveyed out of the spinning pump. The total as-spun denier was 1891 dtex. The residual solvent content in the spun material was 8.8%. The DMF-evaporation rate was 1.727

$$\left[\frac{\text{mg}}{\text{sec. capillary}}\right].$$

The individual as-spun denier was 1.80 dtex. The draft was 80. The filaments were subsequently treated as in described in Example 5a. The fianl fibre denier was 0.58 dtex. The fibres again have the typical dumbbell-shape.

(c) A part of the mixture from Example 5 was dissolved in the heating device at 80° C. instead of 135° C., was filtered and the spinning solution was again maintained at 112° C. upstream of the nozzle. The filaments were then spun as is described in Example 5a. The filaments could not be spread. Tears appeared constantly below the nozzle.

(d) Another part of the mixture was dissolved in the heating device at 80° C. instead of at 135° C., was filtered and the spinning solution was cooled at 40° C. The solution had a viscosity of 235 falling ball seconds at 50° C. At 40° C., the viscosity rose to 356 falling ball seconds, and the solution became turbid. In an experiment to spin a solution of the type as described in Example 5a, no filaments could be obtained. Tears occured constantly below the nozzle.

EXAMPLE 6

35 kg of an acrylonitrile copolymer having the chemical composition of Example 1 was dissolved in 65 kg of DMF as is described there. The spinning solution was then filtered, cooled and 35° C. and dry spun from a 360-hole spinneret having a nozzle hole diameter of 0.3 mm. The shaft temperature was 50° C., the air temperature was 200° C. and the quantity of air was 40 $m^3/h$. The draw-off rate was 300 m/min. The residence time in the spinning shaft was 1.16 seconds. 126.8 ccm/min were conveyed out of the spinning pump. The total denier was 1391 dtex. The residual solvent content in the spun material was 35.5%. The DMF-evaporation rate was 2.902

$$\left[\frac{\text{mg}}{\text{sec. capillary}}\right].$$

The individual as-spun denier was 3.86 dtex. The draft was 60. The filaments were subsequently treated with a stretching ratio of 1:4.0) to form fibres with a final denier of 1.2 dtex. The fibres have a dumbbell-shaped cross-sectional profile. While with a 70.5% spinning solution concentration, the transition of the cross-sectional form from being round to a dumbbell-shaped, with a 1.16 seconds residence time in the spinning shaft according to FIG. 1, is only to be expected at an evaporation rate of 3.05

$$\left[\frac{\text{mg}}{\text{sec capillary}}\right],$$

the transition of the cross-sectional form from being round to a dumbbell shape thus takes place much earlier with a 65% spinning solution concentration according to $$R^1 = \frac{C_{1\,DMF}}{C_{2\,DMF}} \times R_2;\ R_1 = \frac{65}{70.5} \times 3.05 = 2.91 \left[\frac{\text{mg}}{\text{sec. cap.}}\right]$$

We claim:

1. A process for the production of synthetic acrylonitrile fibers and filaments having at least 40% by weight acrylonitrile units and individual as spun deniers of 3 dtex and less from filament-forming synthetic polyacrylonitrile polymers containing at least 40% by weight acrylonitrile units by a dry spinning process and further treating the spun material in a manner known per se to produce finished fibers or filaments, comprising spinning a viscosity-stable spinning solution in an organic solvent under thermal conditions such that a draft of at least 30 is established.

2. A process according to claim 1, in which dimethyl formamide is used as the spinning solvent.

3. A process according to claim 1, in which the spinning solution is spun with a draft of from 30 to 500.

4. A process according to claim 1, in which filaments are produced having round to bean-shaped cross sections.

5. A process according to claim 1, wherein said viscosity stable spinning solution contains a polar organic solvent.

6. A process according to claim 5, wherein said polar organic solvent is selected from the group consisting of dimethyl acetamide, dimethyl sulphoxide, ethylene carbonate and N-methyl pyrrolidone.

* * * * *

UNITED STATES PATENT AND TRADEMARK OFFICE

CERTIFICATE OF CORRECTION

PATENT NO. : 4,400,339

DATED : August 23, 1983

INVENTOR(S) : Ulrich Reinehr et al

It is certified that error appears in the above-identified patent and that said Letters Patent is hereby corrected as shown below:

| | |
|---|---|
| Under U.S. Patent Documents | Fifth line, delete "Lowasser" and insert --Lohasser-- |
| Col. 3, line 50 | Delete "alow" and insert --allow-- |
| Col. 5, line 50 | After "number of holes x" delete "$\alpha$" and insert --60-- |
| Col. 6, line 57 | Delete "upon" and insert --spun-- |
| Col. 10, Table | No. 1, under "conveyed quantity" delete "39.16" aind insert --39.6-- |
| Col. 7, line 8 | Delete "acid" and insert --method-- |

Signed and Sealed this

*Twenty-eighth* Day of *February 1984*

[SEAL]

*Attest:*

GERALD J. MOSSINGHOFF

*Attesting Officer*

*Commissioner of Patents and Trademarks*